US005612721A

United States Patent [19]

Ishize

[11] Patent Number: 5,612,721

[45] Date of Patent: Mar. 18, 1997

[54] INK JET RECORDING DEVICE

[75] Inventor: Tatsuhiro Ishize, Ebina, Japan

[73] Assignee: Fuji Xerox Co., Ltd., Tokyo, Japan

[21] Appl. No.: 428,674

[22] Filed: Apr. 25, 1995

[30] Foreign Application Priority Data

May 24, 1994 [JP] Japan ..... 6-109735

[51] Int. Cl.[6] ..... B41J 2/165

[52] U.S. Cl. ..... 347/33

[58] Field of Search ..... 347/22, 32, 33

[56] References Cited

U.S. PATENT DOCUMENTS

| | | | |
|---|---|---|---|
| 5,266,974 | 11/1993 | Koitabashi et al. | 347/33 |
| 5,394,178 | 2/1995 | Grange | 347/32 |

FOREIGN PATENT DOCUMENTS

| | | | |
|---|---|---|---|
| 3-246052 | 11/1991 | Japan | 347/33 |
| 4-77669 | 12/1992 | Japan . | |
| 5-201014 | 8/1993 | Japan | 347/33 |

*Primary Examiner*—John E. Barlow, Jr.
*Attorney, Agent, or Firm*—Oliff & Berridge

[57] ABSTRACT

An ink jet recording device is disclosed, comprising:

recording heads for ejecting ink and printing on recording media;

a carriage member having said recording heads and moving reciprocatingly between a printing region and a non-printing region; and a cleaning member for cleaning a (front) surface, which has nozzles, of said recording heads by contacting with said surface when said carriage member enters said non-printing region, and said cleaning member moving to a position at which said cleaning member is capable of contacting with said surface, which has said nozzles, of said recording heads, linking with a movement, which is for entering said non-printing region, of said carriage member, and moving to a position at which said cleaning member does not contract with said surface, which has said nozzles, of said recording heads, linking with the passage of an engaging portion of carriage side at a position of a projecting engaging portion of blade holder side when said carriage member is moved from said non-printing region to said printing region.

12 Claims, 5 Drawing Sheets

INK JET RECORDING DEVICE

FIELD OF THE INVENTION

The present invention relates to an ink jet recording device which carries out recording by ejecting ink from nozzles (ejection openings) and especially to an ink jet recording device having a simplified cleaning mechanism for nozzles of recording heads.

BACKGROUND OF THE INVENTION

In an ink jet recording device, soils such as unnecessary ink and debris attach to nozzles and areas around them, and a cleaning blade comprising an elastic body such as rubber for removing the soils is provided. A cleaning blade cleans nozzles of recording heads and areas around them by wiping these soils.

Generally, cleaning of recording heads by a cleaning blade is carried out by making the cleaning blade contact with the (front) surface of the recording heads, that is, the surface, which has nozzles, of recording heads (recording head surface) and sliding the cleaning blade with respect to the recording heads, when the recording heads are moved in accordance with the reciprocating (forward and backward) scanning of a carriage member having the recording heads. However, when the cleaning blade is moved reciprocatingly with respect to the recording heads and is made to contact with them and slide with respect to them, the soils such as unnecessary ink and debris pushed to one side when the cleaning blade is moved forward are pushed back to another side when the cleaning blade is moved backward, and the soils such as unnecessary ink and debris which are once removed attach to the nozzles again, so enough effects cannot be obtained.

Therefore, when cleaning, it is necessary to restrict the direction, in which the cleaning blade that contacts the recording heads is slided, to one direction. In conventional examples, by providing means for approaching a cleaning blade toward recording heads and keeping it away from the recording heads, the cleaning blade contacts with the recording heads only when required.

However, to make the cleaning blade approach the recording heads and keep it away from them, an individual motor or solenoid is necessary, which has increased the producing cost.

To avoid such an extra cost, for example, an ink jet recording device disclosed in Japanese examined patent publication Hei 4-77669 is structured so that a cleaning blade moves, only when a cap member advances, to a position at which cleaning of the surface, which has nozzles, of recording heads is possible, linking with the movement of the cap member and that the state wherein the cleaning blade is stopped at the position is unlocked by the movement, after cleaning the recording heads, of the carriage.

With the above described disclosed ink jet recording device, the cleaning blade can be moved away from the recording heads without using an individual motor or solenoid, but for making the cleaning blade approach the recording heads, an individual motor or solenoid is necessary.

SUMMARY OF THE INVENTION

It is an object of the present invention to provide an ink jet recording device free of the defects found in the conventional arts.

It is another object of the present invention to provide an ink jet recording device capable of positive cleaning, in one direction, of a cleaning blade, by a simple structure.

It is a further object of the present invention to provide an ink jet recording device capable of making a cleaning blade approach a surface of recording heads and keeping it away from the surface to a predetermined position, without providing a particular cleaning blade driving mechanism.

It is a yet further object of the present invention to provide a simple and economical ink jet recording device wherein a reduced number of components is used.

Additional objects and advantages of the invention will be set forth in part in the description which follows and in part will be apparent from the description, or may be learned by practice of the invention.

An ink jet recording device according to the present invention comprises:

recording heads for ejecting ink and printing on recording media;

a carriage member having the recording heads and moving reciprocatingly between a printing region and a non-printing region; and a cleaning member moving to a position at which the cleaning member is capable of contacting with the (front) surface, which has nozzles, of the recording heads, linking with the movement, which is for entering the non-printing region, of the carriage member, and moving to a position at which the cleaning member does not contact with the recording head surface, linking with the passage of an engaging portion of carriage side at the position of a projecting engaging portion of blade holder side when the carriage member is moved from the non-printing region to the printing region.

The cleaning member of the ink jet recording device also comprises:

a cleaning blade made to contact with a recording head surface, for cleaning the recording head surface having nozzles; and a blade holder having a cleaning blade and the projecting engaging portion which is made by extending a blade supporting portion at one end of the blade holder and the other end of which is positioned at the height higher than the bottom of the carriage member and in the way (course) wherein the carriage member is transported, and which is attached rotatably to the recording device by a mounting means used as a rotation axis, and the end portion, which has the cleaning blade, of the blade holder and the recording device are connected by an urging member.

Further, the carriage member has, at the trailing edge in the direction progressing from the non-printing region to the printing region, an engaging means for engaging with the projecting engaging portion of the blade holder whose cleaning blade is at the position capable of contacting with the surface, which has nozzles, of the recording heads.

Linking with the movement, for entering the non-printing region, of the carriage member, the blade holder is rotated, the cleaning member is moved to the position capable of contacting with the recording head surface and it cleans the recording head surface when the carriage member is moved away from the non-printing region, and after the cleaning is finished, the state wherein the cleaning member contacts with the recording head surface is unlocked, linking with the movement, for moving to the printing region, of the carriage member. Therefore, with the ink jet recording device according to the present invention, the cleaning blade is made to approach or moved away from the recording heads, without an individual motor or solenoid.

BRIEF DESCRIPTION OF THE DRAWINGS

The manner by which the above objects and the other objects, features and advantages of the preset invention are attained will be fully evident from the following detailed description when it is considered in light of the accompanying drawings, wherein.

DETAILED DESCRIPTION OF THE INVENTION

EMBODIMENT

An embodiment according to the present invention is now described, referring to FIGS. 1 to 8.

Figure 8:
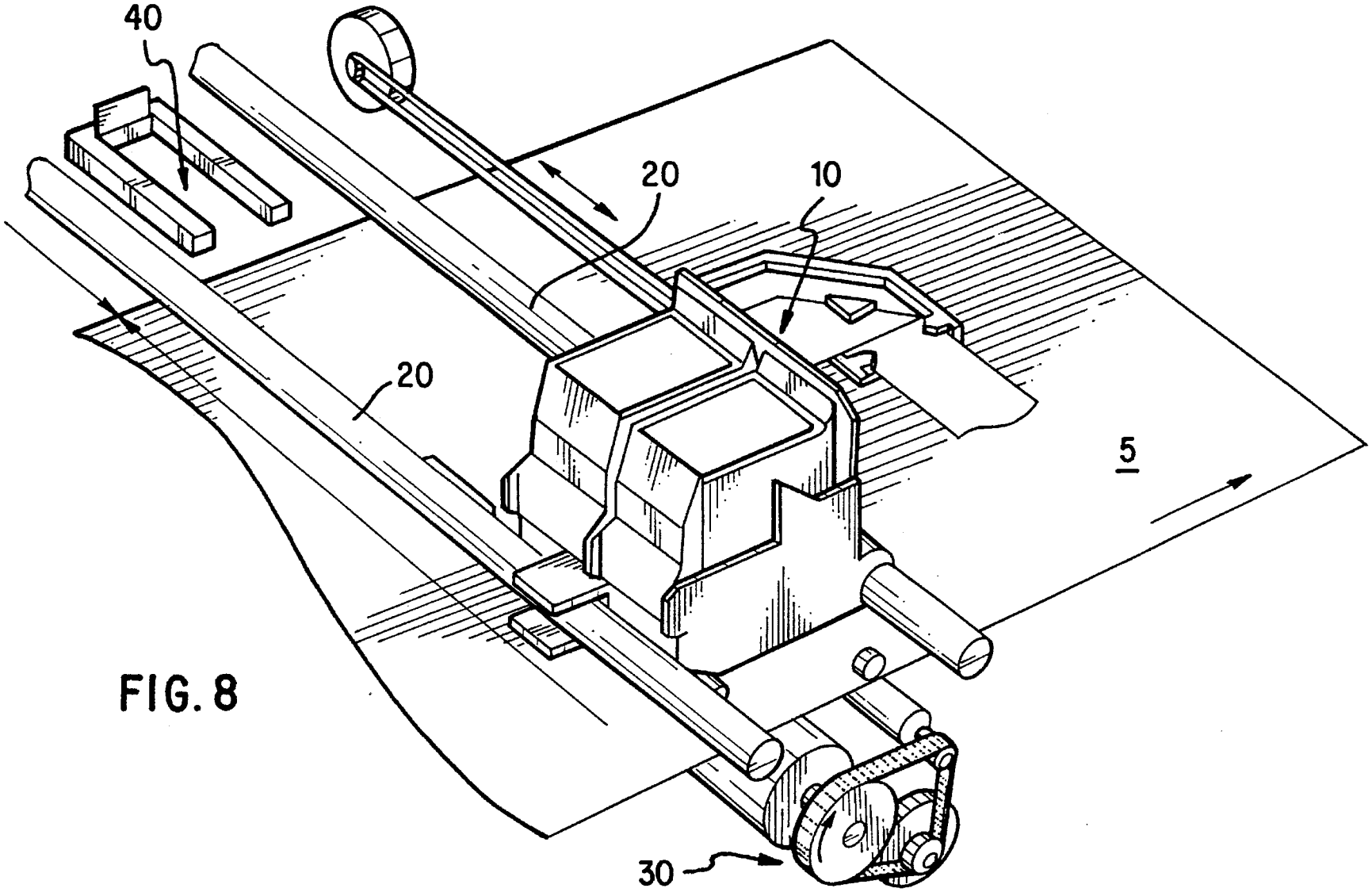
FIG. 8 is a schematic view of the whole ink jet recording device of the embodiment according to the present invention.

FIG. 8 is a schematic view of a whole ink jet recording device according to the present invention and it also shows the movement of carriage 10. Carriage 10 having recording heads 15 provided at the position where they face recording medium 5 is moved recprocatingly by driving device 30 in the scanning direction along scan shaft 20.

When scanning for printing is finished, the carriage 10 is moved from printing region A to non-printing region B, and treatment such as cleaning and drying prevention with respect to the surface, which has nozzles, of recording heads 15 is carried out by recording head maintenance managing portion 40.

Recording head maintenance managing portion 40 comprises a cleaning member for cleaning the surface, which has nozzles, of recording heads 15 by wiping and a capping mechanism (not shown in the figure) for preventing drying.

Figure 1:
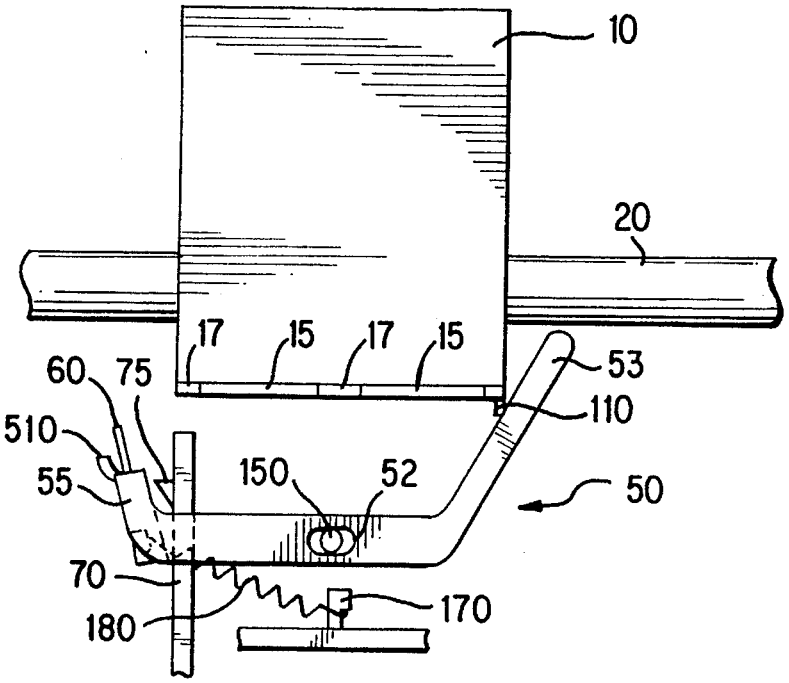
FIG. 1 is a schematic view of the embodiment according toe the present invention.

The cleaning member included in the recording head maintenance managing device is now described in detail, referring to FIG. 1.

Figure 5:
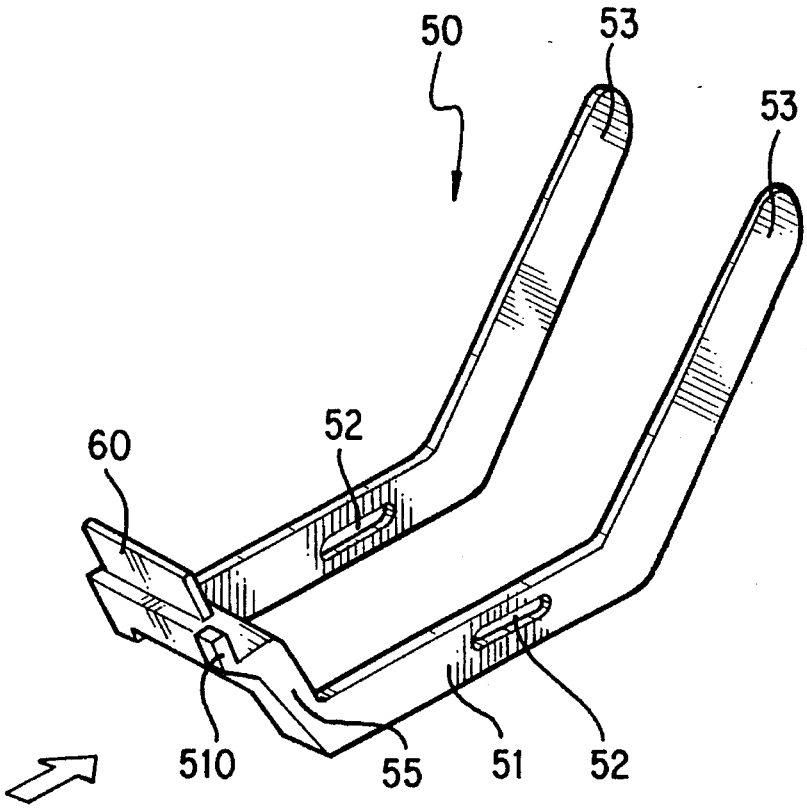
FIG. 5 is a perspective view of a blade holder.
Figure 6:
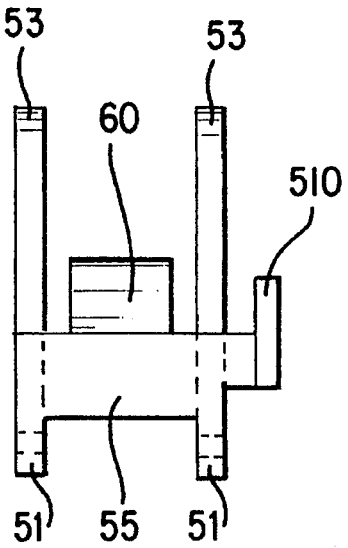
FIG. 6 shows a blade holder, seen from the side of the front surface of a cleaning blade.
Figure 7:
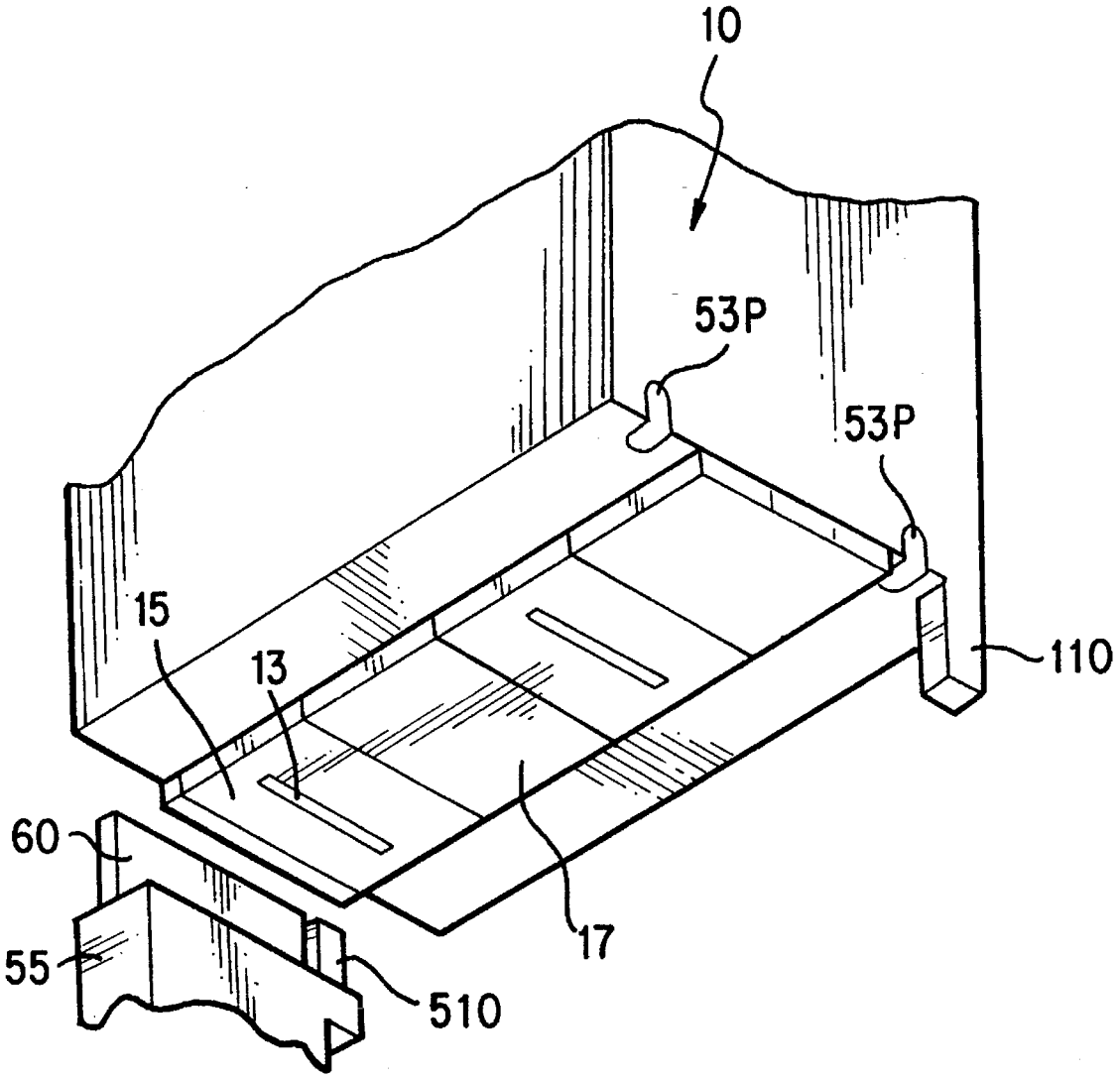
FIG. 7 shows the main portion of the ink jet recording device, seen from underneath.

FIG. 1 is a schematic view of an ink jet recording device according to the present invention, and in it, carriage 10 is positioned in non-printing region B. FIG. 5 is a perspective view of a whole blade holder.

Carriage 10 is scanned reciprocatingly along scan shaft 20. Recording heads 15 having opened nozzles 13 and absorber 17 for liquid such as ink, which is adjacent to recording heads 15 and for cleaning the below described cleaning blade, are provided in the surface, which faces recording medium 5, of carriage 10. In this surface of carriage 10, engaging portion of carriage side 110 is also provided, projecting downward.

The cleaning member comprises blade holder 50 and cleaning blade 60 attached to blade holder 50. The cleaning member is provided at the position under the non-printing portion B of the device and corresponding to recording heads 15 of carriage 10.

Blade holder 50 of the cleaning member has parallel two arms 51, contacting portions 53 made by extending one end of each of arms 51 in the direction toward scan shaft 20 and blade supporting portion 55 made by connecting the other end of each of arms 51. Slots 52 are provided approximately in the center in the direction along the longest side of arms 51, and cleaning blade 60, which comprises an elastic material such as polyurethane or epoxy resin and which is in the form of a plate, is provided at the top of blade supporting portion 55. Further, projecting engaging portion of the holder side 510, which is a prominent edge projecting outward with respect to cleaning blade 60 provided on blade supporting portion 55, is made by extending the upper portion of blade supporting portion 55 in the direction toward scan shaft 20.

The attachment of thus structured blade holder 50 having cleaning blade 60 is now described.

Blade holder 50 engages engaging member 150 with the recording device through slots 52 and is supported rotatably, with cleaning blade 60 and contacting portion 53 positioned in the side of printing region A and non-printing region B respectively (Here, seen from above, arms 51 are parallel to scan shaft 20), by the maintenance managing device, using slots 52 of arms 51 as rotation centers. Further, blade holder 50 is urged toward prominent portion 170 provided in an appropriate position of the recording device by connecting blade supporting portion 55 of blade holder 50 with spring 180, which is an urging member attached to prominent portion 170.

Figure 2:
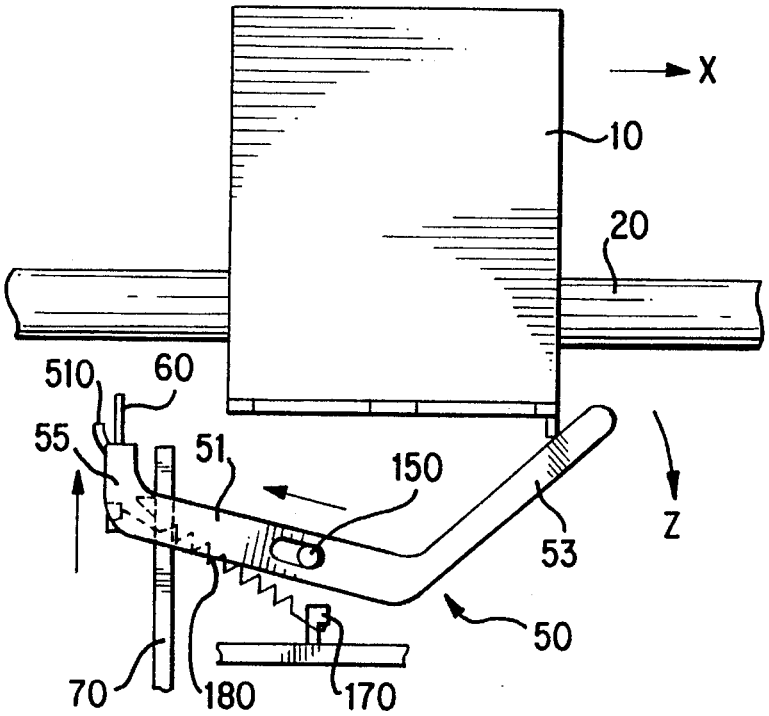
FIG. 2 shows the behavior of the main portion of an ink jet recording device according to the present invention.
Figure 3:
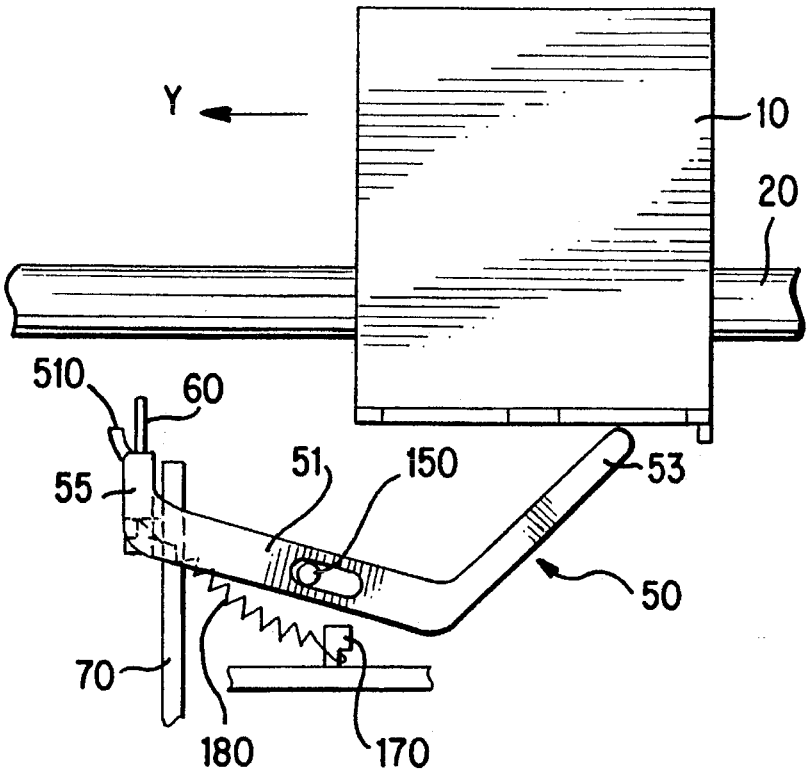
FIG. 3 shows another behavior of the main portion of the ink jet recording device according to the present invention.
Figure 4:
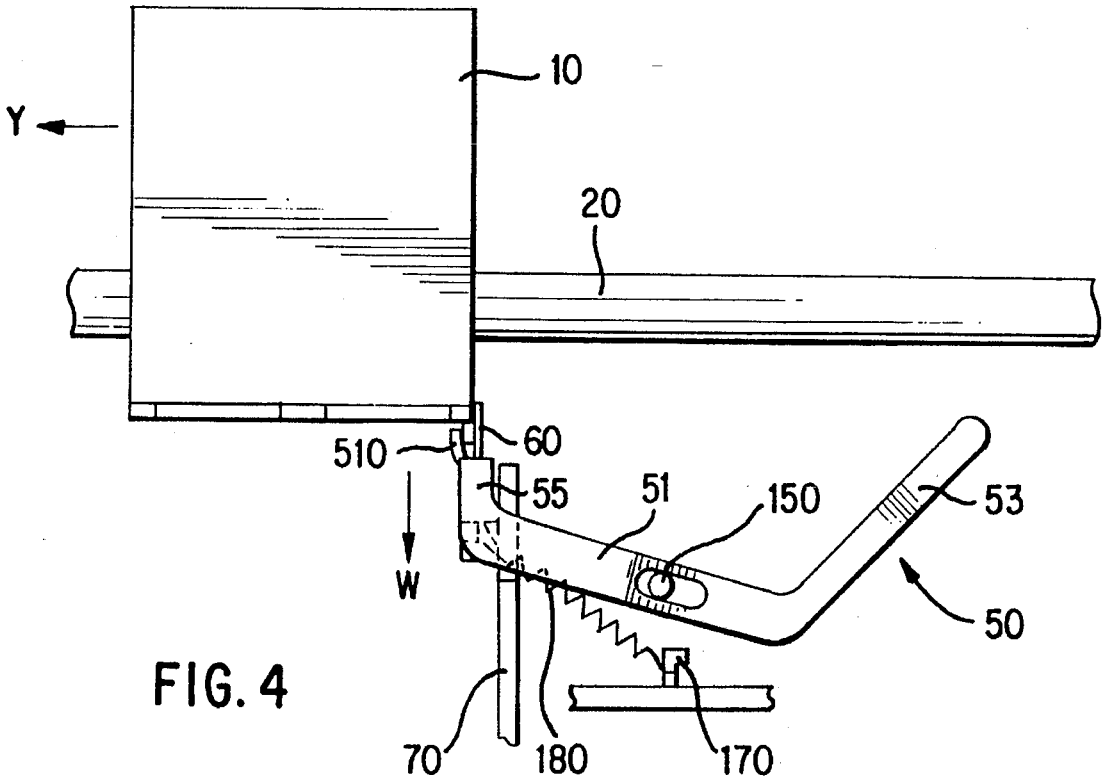
FIG. 4 shows yet another behavior of the main portion of the ink jet recording device according to the resent invention.

The relation between the behavior of carriage 10 and that of cleaning blade 60 is now described, referring to FIGS. 2 to 4.

FIG. 2 shows the case where carriage 10 is positioned in non-printing region B and it is to progress in the direction of arrow X.

When carriage 10 progresses in the direction of arrow X, contacting portions 53, which are provided at the position capable of contacting carriage 10, collide against carriage 10 at contact points 53P (shown in FIG. 7) of carriage 10. By the progress of carriage 10, contact portions 53 are pressed down and arms 51 are rotated, centered on engaging member 150 supported by slots 52, in the direction of arrow Z. In accordance with the rotation of arms 51, cleaning blade 60 rises in the direction of scan shaft 20. Here, blade stopping projecting portion 75 attached to mounting portion 70 is provided at an appropriate position (the position where blade stopping projecting portion 75 contacts with blade supporting portion 55 when blade holder 50 is rotated) of the device. Although blade supporting portion 55 collides with blade stopping projecting portion 75 of the recording device in accordance with the rotation of blade holder 50, it can avoid contacting with the blade stopping projecting portion 75, since engaging member 150, which is a rotation shaft, moves within slots 52 and blade supporting portion 55 goes over blade stopping projecting portion 75. Moreover, when carriage 10 is moved in the direction of arrow X, blade supporting portion 55 of blade holder 50 which has gone over blade stopping projecting portion 75 is urged by spring 180 and stopped on blade stopping projecting portion 75.

Here, cleaning blade 60 attached to blade supporting portion 55 is moved to the position capable of contacting with recording heads 15, and even if carriage 10 progresses in the direction of arrow X more, in this state, cleaning blade 60 is kept in the position capable of contacting with recording heads 15, since blade holder 50 is stopped on blade stopping projecting portion 75.

FIGS. 3 to 4 show the case where carriage 10 is positioned from non-printing region B to printing region A as it is to progress in the direction of arrow Y.

When carriage 10 is moved to printing region A, that is, in the direction of arrow Y, cleaning blade 60 contacts with recording heads 15, and cleaning is carried out by sliding cleaning blade 60 with respect to the surface, which has nozzles, of recording heads 15.

The behavior of blade holder 50 when carriage 10 reaches the position shown in FIG. 4, that is, when cleaning of recording heads 15 is finished is now described.

When carriage 10 progress more, from this state, in the direction of arrow Y, that is, in the direction of printing region A, engaging portion of carriage side 110 and projecting engaging portion 510 provided in blade supporting portion 55 of blade holder 50 are engaged. Blade holder 50 is pulled in the direction of Y in accordance with the progress of carriage 10, and blade supporting portion 55 is made to get out of blade stopping projecting portion 75 of the recording device. Blade holder 50 is then rotated in the urged direction, that is, the direction of arrow W, by the urging force of spring 180, and it is returned to the initial state.

By repeating the above described behaviors by the movement of carriage 10, moving of cleaning blade 60 to the position capable of cleaning recording heads 15 and moving of it away from the position are carried out.

Thus, cleaning blade 60 for cleaning recording heads 15 by being slided with respect to the surface, which has nozzles, of the recording heads of the ink jet recording device carries out being moved to recording heads 15 and being moved away from them positively without an individual motor or solenoid.

With an ink jet recording device according to the present invention, contacting of a cleaning blade of a cleaning member with recording head surface and retreating it to a predetermined position are carried out, without providing a particular cleaning member driving mechanism.

Further, compared with conventional ink jet recording devices comprising a cleaning member driving mechanism, ink jet recording device according to the present invention is simple, economical, with smaller number of component items. Moreover, with the ink jet recording device according to the present invention, as cleaning of recording heads in one direction can be carried out, linking with the movement of a carriage member, operation efficiency can be improved.

What is claimed is:

1. An ink jet recording device comprising:

recording heads for ejecting ink and printing on recording media;

a carriage member having said recording heads and moving reciprocatingly between a printing region and a non-printing region, said carriage member further having an engaging portion; and a cleaning member, having a projecting engaging portion, for cleaning a surface of said recording heads by contacting with said surface when said carriage member exits said non-printing region, said cleaning member linking with a movement of said carriage member when the carriage member is transported toward the non-printing region for moving to a position at which said cleaning member is capable of contacting with said surface of said recording heads upon said carriage member moving to the printing region, and said cleaning member linking with the passage of the engaging portion of said carriage member at a position of the projecting engaging portion of said cleaning member after said cleaning member contacts with said surface to move said cleaning member to a position at which said cleaning member separates from said surface of said recording heads, such that said cleaning member does not contact said surface of said recording heads when said carriage member is moved from said printing region to said non-printing region.

2. The ink jet recording device described in claim 1, wherein the cleaning member further comprises:

a cleaning blade made to contact with said surface of said recording heads, for cleaning said surface; and a blade holder having a cleaning blade at a first end and said projecting engaging portion made by extending a blade supporting portion of said blade holder, wherein said blade holder is attached rotatably to said recording device by a mounting means used as a rotation axis, said blade holder having a second end positioned at the height higher than the bottom of said carriage member wherein said blade holder is rotated upon said cleaning member linking with said movement.

3. The ink jet recording device described in claim 2, wherein said first end of said blade holder and said recording device are connected by an urging member.

4. The ink jet recording device described in claim 2, wherein there is a blade stopping means for stopping said blade supporting portion in a position at which said cleaning blade of said blade holder rotates and contacts with said surface of said recording heads.

5. The ink jet recording device described in claim 2 wherein said carriage member has, at a trailing edge in a direction progressing from said non-printing region to said printing region, an engaging means to engage with said projecting engaging portion of said blade holder when said cleaning blade is in the position at which said cleaning blade can contact with said surface of said recording heads.

6. The ink jet recording device described in claim 2, wherein said mounting means includes slots for rotational and sliding movement of said cleaning member when said carriage member is moved.

7. An ink jet recording device comprising:

recording means for ejecting ink and printing on recording media;

carrying means for having said recording means and moving reciprocatingly between a printing region and a non-printing region, said carrying means further having an engaging portion; and means for cleaning a surface of said recording means by contacting with said surface when said carrying means exits said non-printing region, said cleaning means having a projecting engaging portion, said cleaning means linking with a movement of said carrying means when the carrying means is transported toward the non-printing region for moving to a position at which said cleaning means is capable of contacting with said surface of said recording means upon said carrying means moving to the printing region, and said cleaning means linking with the passage of the engaging portion of said carrying means at a position of the projecting engaging portion of said cleaning means after said cleaning means contacts with said surface to move said cleaning means to a position at which said cleaning means separates from said surface of said recording means such that said cleaning means does not contact said surface of said recording means, when said carrying means is moved from said printing region to said non-printing region.

8. The ink jet recording device described in claim 7, wherein said cleaning means further comprises:

a cleaning blade made to contact with said surface of said recording means, for cleaning said surface; and blade holding means for holding said cleaning blade at a first end and said projecting engaging portion made by extending a blade supporting portion of said blade holding means, wherein said blade holding means is attached rotatably to said recording means by a mounting means used as a rotation axis, said blade holding means having a second end positioned at the height higher than the bottom of said carrying means, wherein said blade holding means is rotated upon said cleaning means linking with said movement.

9. The ink jet recording device described in claim 8, wherein said first end of said blade holding means and said recording means are connected by an urging means.

10. The ink jet recording device described in claim 8, wherein there is a blade stopping means for stopping said blade supporting portion in a position at which said cleaning blade of said blade holding means rotates and contacts with said surface of said recording means.

11. The ink jet recording device described in claim 8, wherein said carrying means includes, at a trailing edge in the direction progressing from said non-printing region to said printing region, an engaging means to engage with said projecting engaging portion of said blade holding means when said cleaning blade is in the position at which said cleaning blade can contact with said surface of said recording means.

12. The ink jet recording device described in claim 8, wherein said mounting means includes slots for rotational and sliding movement of said cleaning means when said carrying means is moved.

* * * * *